United States Patent [19]

Neal et al.

[11] 4,426,867

[45] Jan. 24, 1984

[54] METHOD OF PEENING AIRFOILS AND THIN EDGED WORKPIECES

[75] Inventors: James W. Neal, Columbia; Joseph F. Loersch, Bolton, both of Conn.

[73] Assignee: United Technologies Corporation, Hartford, Conn.

[21] Appl. No.: 300,718

[22] Filed: Sep. 10, 1981

[51] Int. Cl.[3] ..... B21J 00/00

[52] U.S. Cl. ..... 72/53; 29/90 A; 29/156.8 B; 416/241 R

[58] Field of Search ..... 72/53; 29/90 A, 156.8 B; 51/417, 419; 416/241 R

[56] References Cited

U.S. PATENT DOCUMENTS

| | | | |
|---|---|---|---|
| 2,881,506 | 4/1959 | Fuchs | 29/90 |
| 3,423,976 | 7/1969 | Burney et al. | 72/53 |
| 3,482,423 | 12/1969 | Murray et al. | 72/53 |

OTHER PUBLICATIONS

Metal Improvement Co., "Shot Peening Applications" 6th Ed. (1980) pp. 17, 35.

Pangborn Corp., "Shot Peening" (Peening Equip. Section), circa 1961.

ASM "Shot Peening" Metals Handbook, vol. 2 (1964) p. 398-405.

*Primary Examiner*—Francis S. Husar
*Assistant Examiner*—David B. Jones
*Attorney, Agent, or Firm*—C. G. Nessler

[57] ABSTRACT

Shot peening of thin edges of workpieces which are subject to deformation damage by direct impacts is accomplished by rotating the workpiece edge near centerline through a particular angle measured from the normal to the shot streamline. The angle is sufficient to cause oblique blows on the centerline of the edge, but insufficient to cause direct impacts. Compressive stresses by the oblique blows provide residual compressive stresses along the centerline to the desired depth. The angle is calcuable from the edge radius, the depth of stressing desired at the centerline, and the depth of stressing produced by shot at a reference location. Oscillatory rotation is preferably used to obtain even peening.

5 Claims, 10 Drawing Figures

METHOD OF PEENING AIRFOILS AND THIN EDGED WORKPIECES

TECHNICAL FIELD

The present invention relates to the field of shot peening, most particularly to the shot peening of airfoils for gas turbine engines.

BACKGROUND

The present invention is useful in a process which we describe in patent applications filed contemporaneously herewith. Ser. No. 300,725 "Method for Simultaneous Peening and Smoothing" describes how workpieces are impacted with shot streams comprised of substantially uniform sized spherical particles having substantially uniform velocities. The workpieces which are being peened are simultaneously provided with residual compressive stresses and a smooth surface finish. Ser. No. 300,726 "Shot Peening Apparatus" describes equipment, including a holder for an airfoil which enables practice of the present invention. The disclosures of the foregoing applications are hereby incorporated by reference.

The present invention is especially useful for gas turbine airfoils. The high rotation speeds of gas turbines means that the surface finish of airfoils can greatly influence the efficiency of the machine. Of high interest are titanium blades for the compressor section. These airfoils characteristically have a very thin edge and tend to be cambered; that is, they have a curved cross section, as shown in FIG. 1 herein.

In the prior art processes using small diameter shot impelled by airblasts, it was possible to orient the nozzles in the manner which avoided any severe impact on the edges, while at the same time achieving the desired peening effect. (Of course the prior art processes did not provide the smooth finish which is now desired.) In the processes of the recent inventions, relatively heavy steel shot is allowed to fall by gravity, along an essentially straight vertical path. The airfoil to be peened is placed in the shot streamline, so that it is suitably impacted. As reference to the Figures herein shows there are two principal sides to an airfoil. The logical approach taken initially was to continuously rotate the airfoil during peening. However, when this is done the impact of the shot on the thin edges causes damage to them, as they tend to be rolled over and locally deformed by direct shot impacts. While mechanical masking of the edges may be employed, this not only raises cost, but would prevent the desirable compressive stresses from being imparted to the edges where they are needed for good fatigue life. Similarly, simply disposing the airfoil so that one side is first peened, and then the other, without exposing the edges, won't provide the desired stresses at the edges. Therefore, it has been necessary to develop improved procedures to fully peen an airfoil.

SUMMARY OF THE INVENTION

An object of the invention is to peen airfoils and other articles having thin edges in a manner which produces the desired residual compressive stress layer at the edge, but which avoids unacceptable deformation. An additional object is to accomplish the foregoing, while at the same time producing a smooth surface finish generally.

According to the invention, a workpiece which has rounded edges is peened by rotating the workpiece through an prescribed arc beneath shot traveling along a streamline. The workpiece is rotated from a mean position to a certain maximum oblique angle to the shot streamline. Shot thus is caused to bit the workpiece at an oblique angle to the tangent to the centerline of the edge, but never hits normal to the tangent. Compressive stresses from the oblique shows penetrate to the centerline position. For a particular material, the angle of rotation is dependent on the desired depth of peening at the edge and the radius of the workpiece edge. When the workpiece has two opposing edges to be peened, the rotation is within an arc between two extreme positions, each constituting the maximum angle for the particular edge being presented to the shot stream. The approximate angle of rotation for a particular edge is calcuable from the radius, the depth of stressing desired at the centerline of the edge, and the depth of stressing which a shot impacts produce in the material at a reference location, such as 45 degrees from the centerline. A typical airfoil shape presents a more complex problem because of the camber of curvature of the airfoil and the differences in edge radii from one edge to the other. The angle of airfoil rotation is further dependent on the angular relationship between the mean chamber line and chord at each edge.

Preferably, relatively large steel shot having a substantially uniform diameter in the range 1–2.5 mm is utilized, where the shot is accelerated to a relatively uniform velocity along a straight path by force of gravity. While the objects of the invention can be achieved by single cycle rotation of the workpiece in the shot stream, it is preferred that the workpiece be rotationally oscillated.

BEST MODE FOR CARRYING OUT THE INVENTION

The invention is described in terms of peening an AMS4928 (Ti-6Al-4V by weight) titanium alloy blade for the compressor section of a gas turbine engine. The techniques and apparatus used to accomplish the peening are described in the copending applications mentioned in the background section of this application, the disclosures of which are hereby incorporated by reference.

Basically, a 1.8 mm diameter spherical steel shot is dropped from a height of 0.65 meters, sufficient to provide a peening intensity of 0.25–0.30 N (in mm, as measured by the Almen test in the "N" range).

Figure 1:
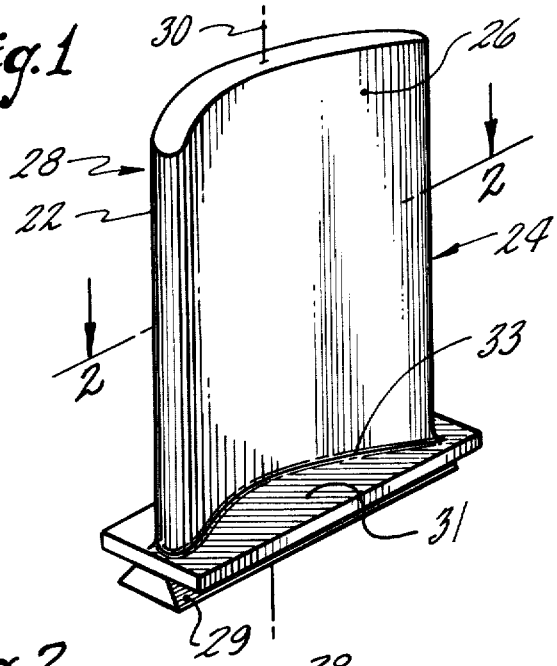
FIG. 1 is a general view of a blade for a gas turbine engine.

A blade is shown in FIG. 1. It has a leading edge 22 and a trailing edge 24 at the intersections of the concave side airfoil surface 26 and the convex airfoil surface 28. The opposing surfaces 26, 28 lie along the longitudinal axis 30 of the blade which has a root 29 and a platform 31 joined to the base of the airfoil by a fillet 33.

Figure 2:
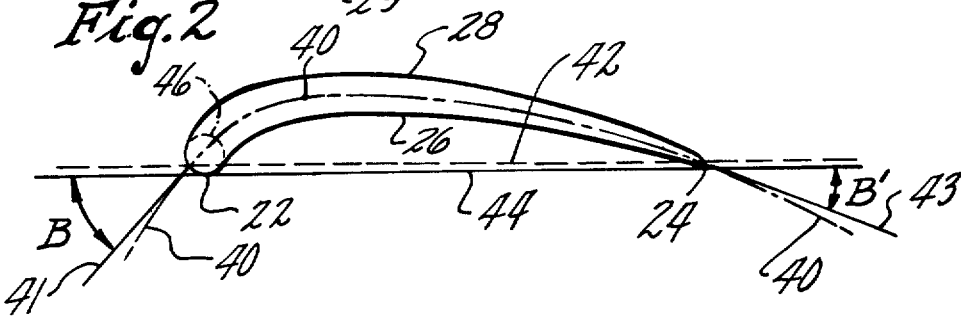
FIG. 2 is a view of a cross section of the airfoil part of the blade in FIG. 1.

FIG. 2 shows a cross section of the airfoil portion of the blade 20 in FIG. 1. An imaginary line, called the bisector or mean camberline 40, runs through the center of the airfoil cross section; it is equidistant from the opposing surfaces 26 and 28. Also shown is the true chord 42 and the false chord 44. The false chord is essentially parallel to, but offset from, the true chord and is used as a reference because it is more conveniently ascertained in an actual workpiece. Reference hereinafter to the "chord" will be a reference to the false chord. A first angle B is formed by the intersection of the chord and the tangent 41 to the camber line at the leading edge 22, and a second angle B' is formed similarly at the thinner trailing edge. The agles B and B' will vary according to the change in camber of the airfoil.

Also shown in the Figure at the leading edge 22 is an imaginary circle 46 which approximately fits the curvature of the leading edge. The radius of the circle serves to delineate the size of the edge. Typically, in compressor airfoils leading and trailing edge radii range between 0.03 to 0.65 mm. The edge radius typically varies along the axial length of an airfoil; it tends to be larger near the base of the airfoil. Another aspect worthy of note here is that the airfoils commonly have "twist." That is, the chord rotates in space and the camber varies along the axial length of the airfoil. These variations are addressed below, in light of the invention.

Figure 3:
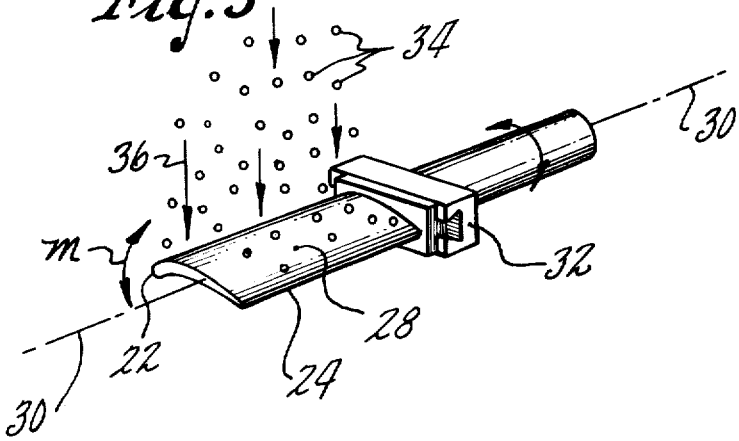
FIG. 3 shows a blade in its holder, illustrating the manner in which the blade is rotationally oscillated during peening.

To accomplish the peening step, the blade is mounted in a holder 32 as shown in FIG. 3. The shot generally strikes the surface 28, which is optionally first to be exposed to the shot stream. It will be noted that since the shot is falling by gravity in the absence of substantial lateral velocity, all the shot 34 is moving along the same streamline 36, as shown in FIG. 2. During the peening step, the shot is allowed to strike the entire surface 28 of the airfoil, although in other circumstances it may not strike the entire surface, if so desired, by means of control of the shot stream pattern.

As the blade's orientation is shown in FIG. 3, the shot would effectively peen the surface 28 and would cause no damage to the leading and trailing edges. However, it should be evident that if the holder 32 was rotated 180° or more, thereby rotating the blade about its longitudinal axis 30, the shot would strike directly on an edge, and it is this which would cause damage. Yet, if the airfoil section of the blade were only impacted as shown in FIG. 3, and with the shot stream stopped, then rotated 180° to impact the opposing side, it would be found that at the extreme edges 22 and 24 there would be insufficient, or no, residual stress.

Figure 4:
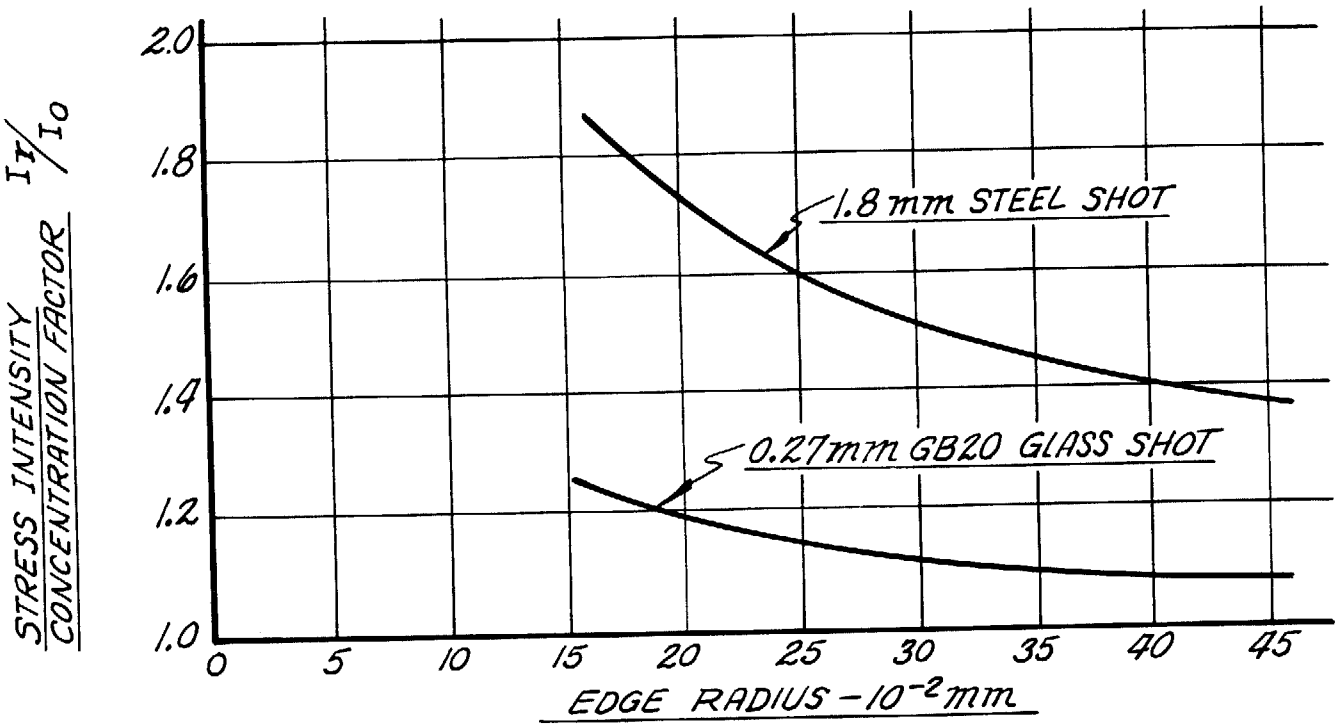
FIG. 4 graphically shows the effect of edge radius on the concentration of stress, for different sizes of shot.

The magnitude of the problem which arises when shot hits the edge can be seen by referring to FIG. 4, which graphically indicates the degree to which the peening intensity, $I_r$, is increased for different edge radii, compared to the intensity, $I_o$, which occurs on a flat plate. By way of example, if the radius of the edge is about 0.45 mm, the peening intensity with 1.8 mm dia shot is 1.35 times greater than the peening intensity which is provided by the same shot impacting a flat surface. If the edge radius is decreased to about 0.20 mm, the concentration factor, $I_r/I_o$, increases considerably to about 1.7. By way of reference, the same concentration factor is shown for GB20 (~0.27 mm) glass beads, which is a media used in the prior art. It may be seen that there is a concentration factor, but that its magnitude is considerably less, as is its rate of change with decreasing radii.

Figure 5:
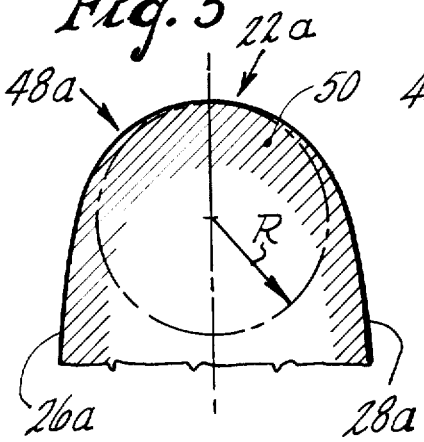
FIG. 5 shows part of an airfoil cross section, illustrating the depth to which compressive stress is induced when the edge radius is relatively large.
Figure 6:
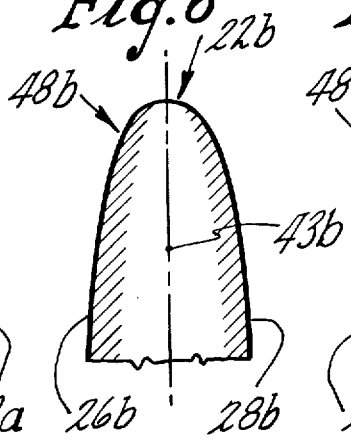
FIG. 6 is similar to FIG. 5, but shows a small radius edge which has been peened on both sides with the airfoil in a static position, and no direct impact on the edge.
Figure 7:
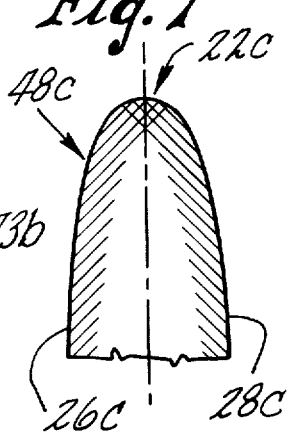
FIG. 7 is similar to FIG. 5 but show an airfoil which has been peened in accord with the invention.

It has been found that limited rotation oscillation of the airfoil, indicated by the arrow C in FIG. 4, can effectively achieve peening of edges without deleterious deformation. The rotational angle through which oscillation is made varies according to the edge radius and camber. This will be illustrated by the example of a particular cross section through an airfoil, such as at the mid-point of its length. FIGS. 5–7 show cross sections of different sized airfoils and by example illustrate the principal underlying the invention. FIG. 5 shows in cross section airfoil **48*a* with a large leading edge radius, R, large enough to permit full airfoil rotation in the shot stream of the airfoil without deformation damage. Because of the intensity concentration factor, the depth of the residual compressive stress layer 50 is greater near the edge 22*a*, than on the opposing surfaces 26*a*, 28*a*. FIGS. 6–7 represent two smaller identical radius airfoils which would suffer leading edge deformation if impacted in a similar manner to that of FIG. 5. FIG. 6 shows an airfoil 48*b* which has been peened without rotation or oscillation with the tangent 43*b* to the camber line at the leading edge normal to shot stream. On the opposing surfaces (26*b*, 28*b*) there is the requisite depth of compressive stressing, but there is insufficient depth at the leading edge 22*b*. FIG. 7 shows an airfoil 48*c* which has been partially rotated (oscillated) during peening, sufficient to expose part of the leading edge 22*c* to the shot stream from both sides, but insufficient to cause direct impacts thereon. The residual stress region on the concave side 26*c* extends into the leading edge, as does that from the convex side 28*c*, and both layers overlap at the edge 22*c***, to provide a sufficiently deep region, nominally comparable to that along the sides.

Figure 8:
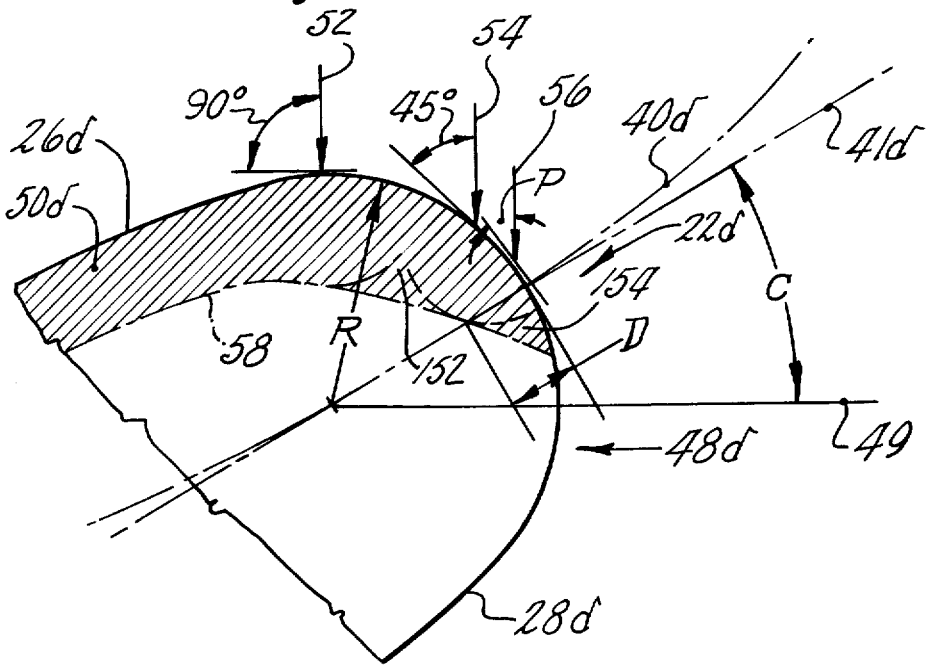
FIG. 8 is a partial cross section of the edge of an airfoil, showing how the compressive stress depth is affected by oblique shot impact angles.

FIG. 8 further illustrates the details of the invention by showing part of the front portion on an airfoil **48*d* having a leading edge radius R, the airfoil being partially rotated an angle M with respect to the normal 49 to the shot streamline, the direction of which is represented by the lines 52, 54, 56. Shot impacting along line 52 hits perpendicular to the local tangent 53 to the airfoil surface and imparts a compressive stress according to its energy and the concentration factor associated with the radius and shot size. Shot traveling along line 54 hits at an oblique angle (45° as shown) with respect to the local tangent 55; shot, for the general case, traveling along line 56 hits at another oblique angle P, to the local tangent 57. Shot hitting the workpiece normal to the tangent will impart energy, $E_n$, to the workpiece. This is a function of its size and peening parameters, as indicated in the copending applications, and the concentration factor. Shot striking at an oblique angle will impart a lesser energy to the workpiece, nominally $E_n$ sine P, and thus the residual stress layer will be less deep in such regions. The curved lines 152, 154 represent the projection into the cross section of the nominal spherical segment of the residual stress layer associated with the individual impacts along the lines 52, 54, according to the studies by Pope and Mohamed, "Residual Plastic Strains Produced by Simple and Repeated Spherical Impact," Journal of Iron and Steel Institute, July, 1955, pp. 285–297. The summation of the stressing from each shot impact provides the residual stress layer 50***d*, extending from the surface to the depth line 58 in FIG. 8. The partial rotation of the workpiece is deemed sufficient when the stress layer depth line 58 at the leading edge 22*d* intersects the mean chamber line 40*d*, at a depth sufficient to provide the needed fatigue improvement in the workpiece. Generally, the depth D will be equal to the reference depth achieved on the opposing airfoil sides 26*d*, 28*d* of the workpiece, although less depth, e.g., about 50–90 percent of the reference depth, is often acceptable.

While the obliqueness of edge impacts lessens the depth of stressing, the radii concentration factor causes an increase. How these factors balance out, and the degree to which an airfoil should be partially rotated is dependent on the radius of the shot and airfoil, and they are discussed below.

The depth of compressive stressing at the leading edge and elsewhere can be readily measured using x-ray diffraction. Thus, the partial rotation of the airfoil necessary to obtain the desired peening at any given edge can be determined by simple experiment. It will be seen that for the cambered airfoil, the total angle of rotation, as measured by the total angle through which the chord moves to peen both edges simultaneously, will be an angle measured from the horizontal plane, or the normal to the shot stream, as shown in FIG. 8. The angle will be greater when the convex side is peened than when the concave side is peened, since the edges of the latter are already turned upward when the chord is disposed normal to the shot stream.

Figure 9:
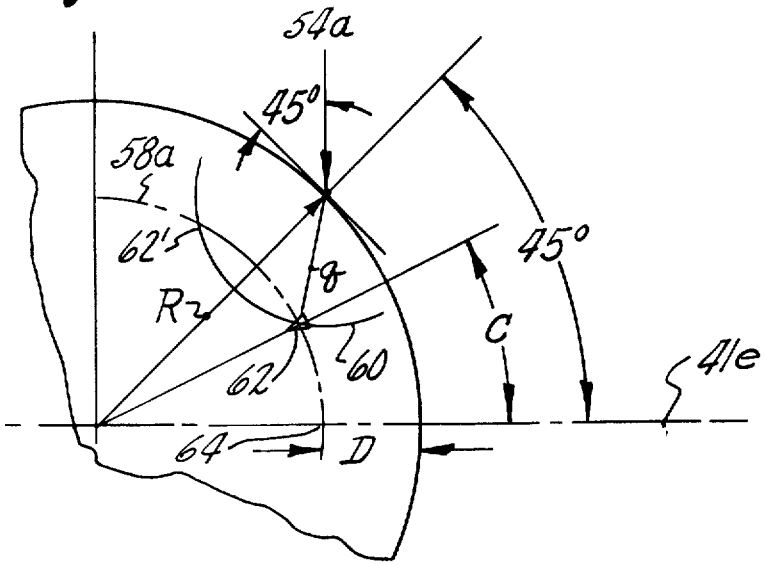
FIG. 9 is a construction drawing, similar to FIG. 8, showing parameters used in analytical calculation of oscillation angle.

It is possible to analytically determine the approximate angle of rotation for airfoils which is useful. It should be understood that the analytical calculation will be approximate, because real edges of airfoils do not have perfect radii (circular cross section); the shot impacts are not perfectly elastic; the $E_n$ sine P relationship is a simplification; and there are simplifying assumptions, as set forth, etc. Suppose it is desired to obtain compressive stressing to a depth D at the leading edge as shown in FIGS. 8 and 9 by the lines 58, 58*a*. (FIG. 9 repeats in part FIG. 8, showing various construction lines referred to herein.) As a reference for analysis, we use in FIG. 9 a shot impact along the line 54*a*, which is at a 45° angle to the mean chamber line tangent 41*e*. The literature indicates that for low intensities there is a more or less linear relationship between the energy in a shot particle and the depth of compressive stressing which is achieved. The depth, q, of stressing at the 45° radial is related to the depth achieved in a normal impact on a flat plate, q will be empirically determinable, as by using X-ray diffraction, for a particular material and shot.

The peening intensity at the point where line 54*a* intersects the surface will be related to the peening intensity $I_o$ which a flat plate receives when hit normally by a shot particle, that is with zero impingement angle. The intensity along the 45° radius R', which produces stressing to a depth q, is $$I_{45} = (I_o)(I_o/I_r)(\text{sine } 45°)$$

where $I_o/I_r$ is the concentration factor.

Each particle produces a stressed area represented by the circle line 60 having a radius q. The line 60 intersects the desired depth line 58*a* at two points, 62, 62' of which only point 62, nearest the camber line, is of interest. From the Figure it should be apparent that the camber tangent line 41*e* should be rotated an angle C, by movement of the airfoil, such that the point 62 coincides with point 64, the intersection of the desired depth line 58*a* with the mean camber line.

The foregoing relations can be geometrically constructed, and reveal that the angle of rotation C in degrees is defined by, $$C = 45° - \cos^{-1}\left(\frac{R^2 + (R - D)^2 - q^2}{2R(R - D)}\right)$$

where R is the radius of the edge circle, D is the depth of desired compressive stressing and q is the depth of compressive stressing produced by an impact at a 45° angle to a surface tangent.

As an example, for a part with an edge radius of 0.38 mm, steel shot of 1.8 mm dia produces a concentration factor of 1.45. The peening intensity, I, on the curved surface at 90° to the tangent is 0.36 N and the depth of stressing is 0.18 mm. For a 45° impact, the intensity will be about 0.25 N and the depth of stressing, q, will be 0.13 mm. Utilizing the formulae above the angle of rotation C will be found to be 33.5 degrees. Angles usually range between 15°–25° for typical parts described herein.

Figure 10:
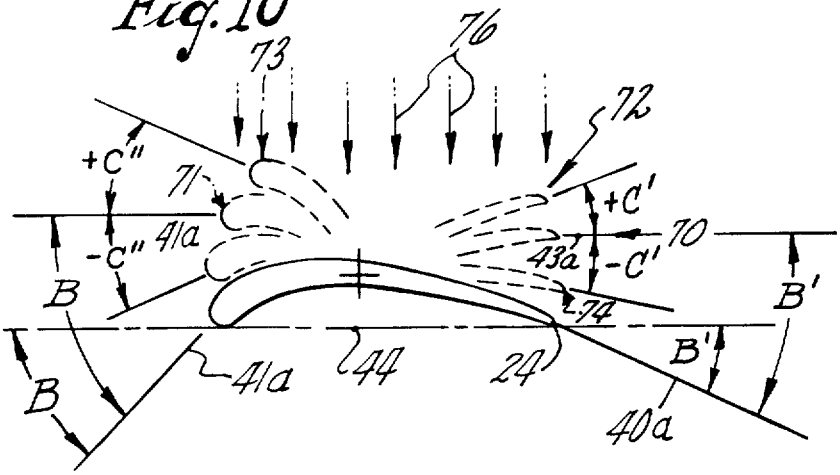
FIG. 10 is an end view of an airfoil showing how it rotates under a shot stream.

Thus it will be seen that the first step in peening a particular side and edge is to rotate the workpiece so that the mean centerline of the edge is normal to the shot streamline. For the trailing edge 24 of the airfoil shown in FIG. 2 and reproduced in FIG. 10, this angle will be B', and the position will be at 70, where the mean centerline, represented by the camber line tangent, 43*a*, is normal to the streamline 76.

Next, the workpiece is rotated so that the mean centerline moves through an angle C, where C is a positive angle less than 90° measured from the normal to the shot streamline, determined as set forth above. For the airfoil shown, this would constitute moving between the position 70 to position 72, by rotation about the longitudinal axis preferably. From FIG. 10, it will be seen that there are corresponding angles, B and C, through which the airfoil moves to similarly expose the opposing leading edge.

In summary, the procedure to peen a single edge is to rotate the workpiece to a first position, by moving through an angle sufficient to place the mean bisector of the edge normal to the shot stream. Then rotate (oscillate) the workpiece from the first position to a second position, through an angle which is a function of the edge radius and depth of stressing desired at the mean bisector location.

To peen two edges simultaneously the airfoil is rotated from the C angle position for the first edge, through the mean position for that edge, and then a further rotation until the C angle position of the second edge is achieved. We have found it most efficient to utilize the latter procedure.

One cycle of rotation to each C angle position would be sufficient to obtain the desired edge peening. However, as will be apparent from FIG. 8 and others herein, when the airfoil is partially rotated, the edge receives more favorable impacts but the airfoil surface 26d receives oblique blows and less than the full desired intensity. Further, to simultaneously peen the two opposing edges, leading and trailing, and to alleviate any variations in the shot stream, it is preferred to rotate the airfoil with a rotational oscillatory motion. The rate of oscillation is somewhat arbitrary, the object being to achieve a fair number of exposures of each edge during the total peening cycle. We have used a rate of 20 cycles/min where the peening time is 2–3 minutes, for a total of 40–60 cycles.

Since the edge and the essentially planar workpiece surfaces located away from the edge cannot both simultaneously receive desirable angle impacts, it would appear that there would be an increase in saturation time with oscillation. In fact, the contrary is observed using Almen strips, and this is attributed to the desirable effects of an inclined workpiece in eliminating interference among the shot particles as they attempt to escape from center workpiece locations. Nonetheless, the duration of peening at the greatest angle C position may be found insufficient to obtain the desired peening at the edge centerline. When observed, a hesitation or temporary pause in the movement at the furthest angle C position will be found useful.

From the foregoing description of the method for the convex side, the procedure for the opposing concave side should now be apparent. As mentioned earlier, the chord has a convenient relationship to the mean camber line which would be known for any given part, from its design. Since the chord is easily measured, it is found more convenient to relate rotations to it.

Earlier it was mentioned that the variations in edge radius and twist should be taken into account. Generally, the blade is more cambered near the base where the edge radii are heavier. For many compressor blades the camber and twist are not great, compared to the angle C. Thus, we have found it workable to select a mean section, at about the midpoint of the length, and establish our parameters based thereon. A check is readily made of whether sections away from the mean obtain unacceptably deviant peening, and the necessary compromises can be made in oscillation angle. When compromise is not possible, a portion of the length can be masked or otherwise not peened, and the part processed in two or more steps.

It should be apparent that the airfoil with its camber, changing radius, and twist, is one of the more complex parts which has edges to be peened. When the workpiece is a more regular or simpler shape, the foregoing principles will be easily applied to determining rotation and oscillation, by reference to the analogous parameters for the workpiece.

While our invention has been described in terms of finishing the essentially circular cross sections of airfoil edges and the like, we believe that the principles of our invention will in special instances be equally applied to edges having other cross sections than circular.

Although this invention has been shown and described with respect to a preferred embodiment, it will be understood by those skilled in the art that various changes in form and detail thereof may be made without departing from the spirit and scope of the claimed invention.

We claim:

1. The method of peening the edge of a workpiece comprising directing a stream of shot along a substantially collimated path, characterized by rotating the centerline of the workpiece edge through an angle C with respect to the normal to the shot path, said angle C being less than 90 degrees, and sufficient to cause oblique impacts at the tangent to the centerline of the edge, but insufficient to cause impacts normal to said tangent, the oblique impacts at points on the edge causing a residual compressive stress along said centerline.

2. The method of claim 1 wherein said spherical shot has a substantially uniform nominal diameter in the range 1–2.5 mm.

3. The method of claim 1 wherein said rotating is characterized by workpiece oscillatory rotation which comprises moving the mean centerline of the edge of the workpiece from its position at angle C and a position normal to the shot streamline for a multiplicity of cycles during peening.

4. The method of claim 1 wherein the workpiece has two opposing edges characterized by rotating the workpiece through an arc, the extremes of which are defined by the angle C for each edge.

5. The method of claim 1, 3, or 4 further characterized by the angle C for an edge being approximately equal in degrees to:

$$C = 45^\circ - \cos^{-1}\left(\frac{R^2 + (R - D)^2 - q^2}{2R\,(R - D)}\right)$$

where R is the radius of the circle which approximately fits the edge, D is the depth of compressive stress desired along the centerline of the edge, and q is the depth of compressive stress produced by an impact at a point on the edge where the tangent to the edge is at a 45 degree angle to the shot streamline.

* * * * *